US005918656A

United States Patent [19]

Daniels et al.

[11] Patent Number: 5,918,656

[45] Date of Patent: Jul. 6, 1999

[54] RETAINING CLIP FOR SIZING A HORIZONTAL MINI-BLIND

[75] Inventors: James Daniels, Freeport; David Jarecki, Rockford; Michael Walsh, Freeport, all of Ill.

[73] Assignee: Newell Operating Company, Freeport, Ill.

[21] Appl. No.: 08/816,019

[22] Filed: Mar. 11, 1997

[51] Int. Cl.[6] ..... E06B 9/30

[52] U.S. Cl. ..... 160/168.1 R; 160/173 R; 160/178.1 R; 160/178.3 R; 29/24.5; 24/155 M; 24/130

[58] Field of Search ..... 160/168.1 R, 173 R, 160/174 R, 176.1 R, 177 R, 178.1 R, 178.3 R, 115; 29/24.5, 702; 24/115 M, 130, 136 R

[56] References Cited

U.S. PATENT DOCUMENTS

| | | | |
|---|---|---|---|
| 2,481,714 | 9/1949 | Bezjian | 160/173 R |
| 2,560,840 | 7/1951 | Barnes, Sr. . | |
| 2,561,141 | 7/1951 | Schaefer | 160/173 R |
| 2,592,995 | 4/1952 | Anderle . | |
| 2,594,806 | 4/1952 | Rosenbaum . | |
| 2,600,062 | 6/1952 | Lorentzen | 160/178.1 R |
| 2,626,659 | 1/1953 | Wright et al. | 160/178.1 R |
| 2,732,011 | 1/1956 | Evans | 160/173 R |
| 3,292,232 | 12/1966 | Nilsson | 29/24.5 |
| 3,687,171 | 8/1972 | Rosenbaum . | |
| 4,073,044 | 2/1978 | Edixhoven | 29/24.5 |
| 4,248,401 | 2/1981 | Mittleman | 24/130 X |
| 4,361,938 | 12/1982 | Emery | 24/130 |
| 4,441,540 | 4/1984 | Tsuhako | 160/178.1 R |
| 4,886,102 | 12/1989 | Debs | 160/177 R |
| 4,945,971 | 8/1990 | Ivarsson et al. | 160/178.3 R |
| 5,072,494 | 12/1991 | Graves et al. | 29/24.5 |
| 5,127,458 | 7/1992 | Schaefer et al. . | |
| 5,655,590 | 8/1997 | Bryant | 160/168.1 R |
| 5,671,509 | 9/1997 | Yeung | 24/130 |

*Primary Examiner*—Daniel P. Stodola
*Assistant Examiner*—Bruce A. Lev
*Attorney, Agent, or Firm*—Foley & Lardner

[57] ABSTRACT

A method for sizing a horizontal mini-blind using a retaining clip. The retaining clip frictionally engages a lift cord threaded through a series of slots formed within a series of horizontal slats. The mini-blinds are sized attaching the retaining clip to the lift cord, cutting the lift cords underneath the retaining clip below the rung cords, then sliding the retaining clip into a channel formed in a bottom rail. The bottom rail includes a pair of oppositely facing notches which receive the ladder cords to prevent further movement of the clip in the channel. The ladder cords and the lift cord are not knotted and captured using a plug in the bottom rail, which results in a flush relationship between the bottom rail and a window opening.

3 Claims, 6 Drawing Sheets

RETAINING CLIP FOR SIZING A HORIZONTAL MINI-BLIND

FIELD OF THE INVENTION

The present invention relates generally to Venetian blind assemblies and more particularly to adjustable mini-blinds.

BACKGROUND OF THE INVENTION

Mini-blinds have been known and used for the selective admission of light into a room and for privacy. Mini-blinds are installed at a window opening and include a series of slats which can be pivoted between an open horizontal position and a closed position wherein the slats are substantially in a vertical configuration.

A conventional mini-blind includes a lift cord inserted through a series of slots within the slats and rung cords positioned underneath and supporting each slat. The rung cords are attached to a pair of ladder cords which are generally perpendicular to the horizontal slats. The lift cords are threaded through the slots in the slats and through an access hole in the bottom rail, then knotted. The ladder cords are brought around the bottom rail and tucked into the same access hole. A plug is then inserted into the access hole to hold all of the cords in place. Typically, the plug protrudes from the bottom rail, thereby allowing excess light to come into the room. It would be advantageous to have a bottom rail flush with the bottom of the window opening, while still allowing a user to adjust the mini-blind for a particular window size.

In order to vertically adjust a typical mini-blind, the plugs are removed from the bottom rail, the lift and ladder cords are cut, the lift cord is threaded through the hole in the bottom rail and knotted, then the lift cord and ladder cords are recapped with the plug. As is evident from the above description, this is often a cumbersome and tedious process, especially if the mini-blind is already hanging and the cords are tensioned, wherein there is a tendency for the lift cord to snap out of several of the slots in the slats. The cords, therefore, often need to be reinserted through the slots in the slats and held in place to facilitate the knotting and plugging of the cords into the bottom rail. There are at least two lift cords in each blind and this problem is compounded when there are several lift cords in one mini-blind. It would be advantageous to have a mini-blind assembly for which the lilt and ladder cords could be held in place prior to the cutting of the cords. Additionally, it would be advantageous to significantly reduce the amount of time, effort and manual dexterity currently required to resize a mini-blind. It would also be advantageous to design an adjustable mini-blind so that a user would not have to rethread and knot any of the cords when the vertical length is adjusted.

SUMMARY OF THE INVENTION

The present invention features an adjustable mini-blind having a retaining clip including a first member with a first surface configured to receive a lift cord and a second member with a second surface also configured to receive the lift cord. The first member cooperates with the second member to frictionally engage the lift cord between the first and second surfaces. The first member further includes a single row of ridges in interlocking pivoted engagement with the second member which includes a double row of cooperating spaced apart ridges configured to receive the single row of ridges therebetween. The single row and double row of ridges frictionally engage the lift cords.

According to another aspect of the present invention, an adjustable mini-blind assembly includes a bottom rail with a pair of spaced apart flanges forming a channel and a series of horizontal slats extending parallel to the bottom rail and having a series of slots formed therethrough to receive a lift cord. Each of the slats is suspended by a rung cord perpendicular to the slats and attached to a pair of vertical ladder cords. The assembly also includes a retaining clip configured to frictionally engage the lift cord and slidably engage the flanges in the channel in the bottom rail. A user can therefore eliminate the unnecessary slats by positioning the clip along the lift cord underneath one of the slats, closing the clip, cutting the lift cord and the ladder cords, and sliding the clip into the bottom rail.

Another aspect of the present invention includes a method of sizing a horizontal mini-blind including the steps of attaching a retaining clip to a lift cord which extends through a series of horizontal slats, cutting the lift cord and a pair of spaced apart ladder cords which extend vertically along the horizontal slats, whereby the clip frictionally engages the lift cord and suspends the bottom rail.

Other advantages of the present invention will become apparent from the detailed description given hereinafter. It should be understood, however, that the detailed description and specific embodiments are given by way of illustration only since, from the detailed description, various changes and modifications within the spirit and scope of the invention will become apparent to those skilled in the art.

DESCRIPTION OF THE DRAWINGS

The preferred exemplary embodiment of this invention will hereinafter be described in conjunction with the appended drawings, wherein like reference numerals denote like elements, and.

DETAILED DESCRIPTION OF A PREFERRED EXEMPLARY EMBODIMENT

Figure 1:
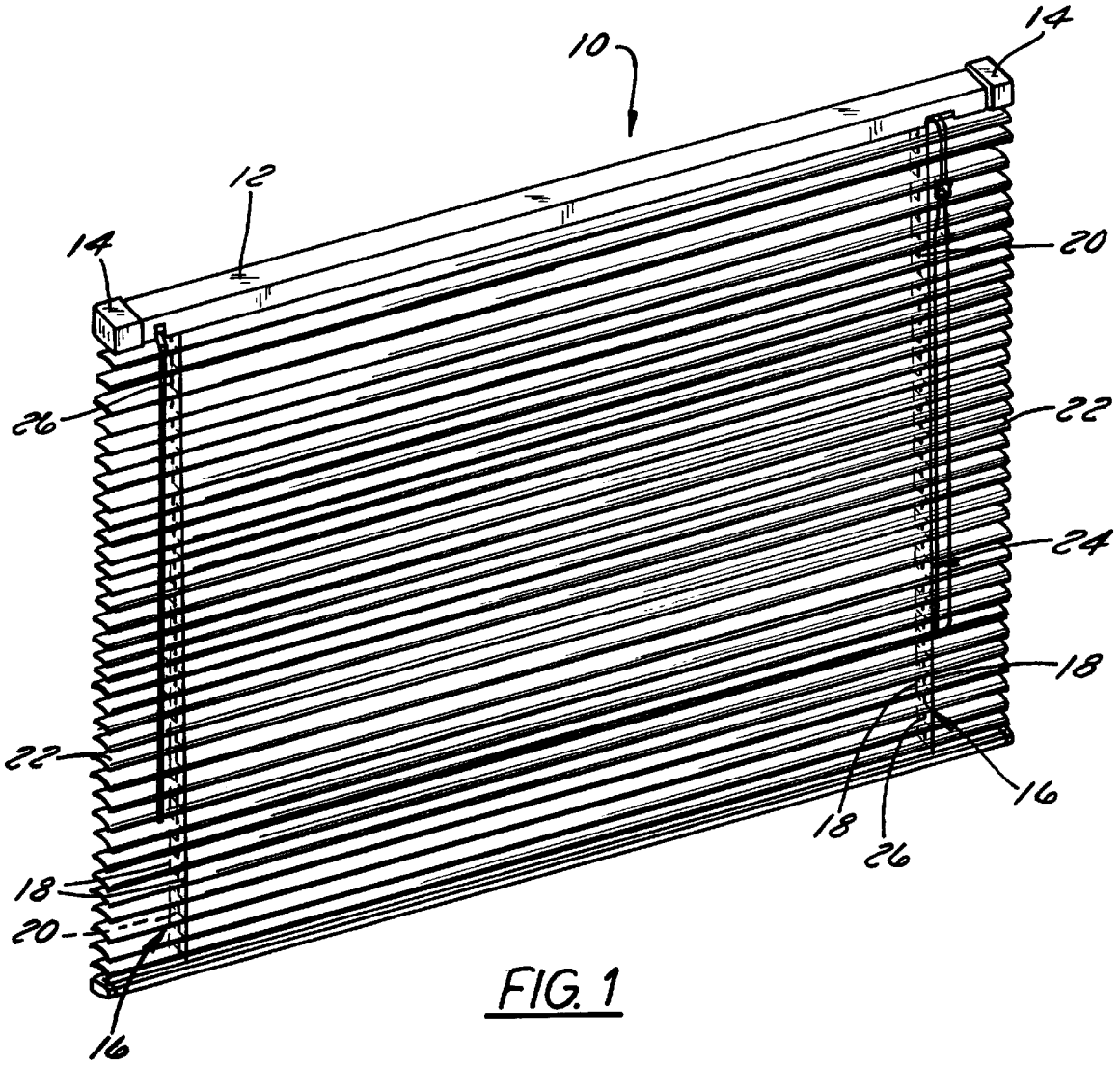
FIG. 1 is a perspective view of a mini-blind assembly according to a preferred form of the present invention showing the overall layout of the main components.
Figure 2:
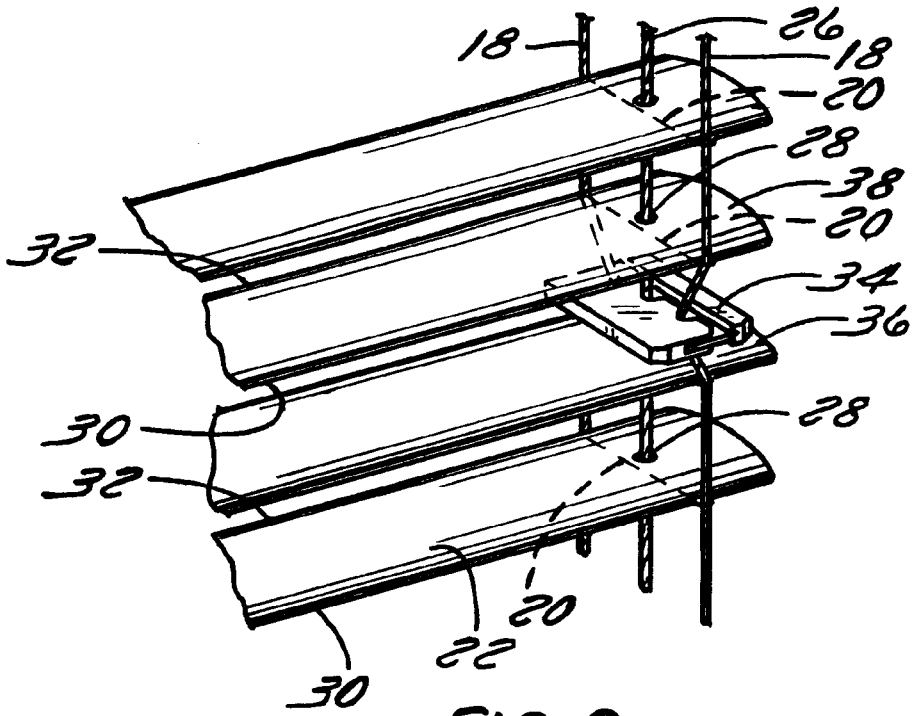
FIG. 2 is a fragmentary schematic view generally showing a configuration of four slats and a retaining clip frictionally engaging a pair of ladder cords and a lift cord between the second and the third slats.
Figure 3:
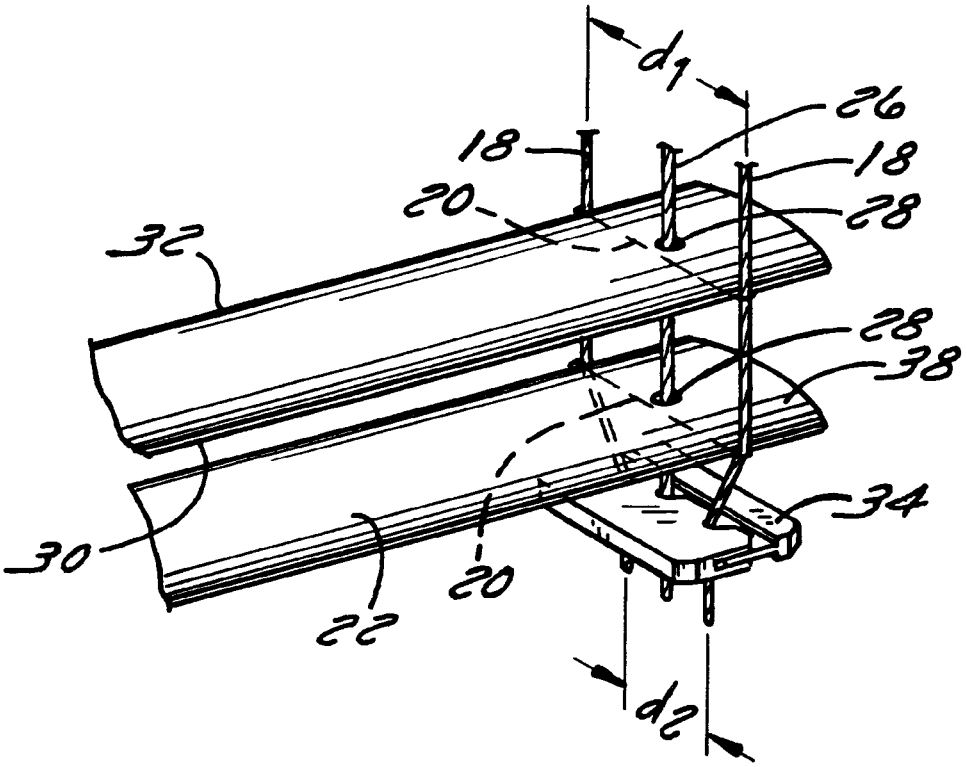
FIG. 3 is a fragmentary schematic view generally showing a configuration of two slats and the retaining clip after the ladder cords and the lift cord have been cut.

Referring generally to FIGS. 1–3, an adjustable mini-blind assembly 10 according to the present invention includes a head rail 12 which is usually mounted near the top of a window opening between a pair of head rail supports 14. As known by those skilled in the art, other support structures, including supports intermediate the ends, could be employed. A flexible ladder 16 is suspended from head rail 12 and includes a pair of side ladder cords 18 and a plurality of rung cords 20, each rung cord 20 connecting together ladder cords 18. A series of pivotable horizontal slats 22 are spaced apart from one another and are supported by rung cords 20 as is well-known in the art. Slats 22 may be raised or lowered in the window opening by a drawcord 24. Drawcord 24 includes a plurality of lift cords 26 threaded through a series of axially aligned slots 28 in slats 22. Slats 22 are not necessarily generally flat, but may be configured as any geometrical shape including but not limited to curved, S-shaped or V-shaped.

As illustrated generally in FIGS. 2–3, ladder cords 18 extend vertically, rest along a first slat edge 30 and a second slat edge 32 and are held in place by rung cords 20 located underneath slats 22. When slats 22 are rotated in a first direction, ladder cord 18 on first slat edge 30 moves downwardly while ladder cord 18 on second slat edge 32 moves upwardly to pivot rung cords 20 and slats 22. When slats 22 are rotated in a second direction, ladder cord 18 on first slat edge 30 moves upwardly while ladder cord 18 on second slat edge 32 moves downwardly to pivot slats 22 in the opposite direction. In this manner, slats 22 are pivoted between a fully open (horizontal) and a fully closed (vertical) position.

Figure 4:
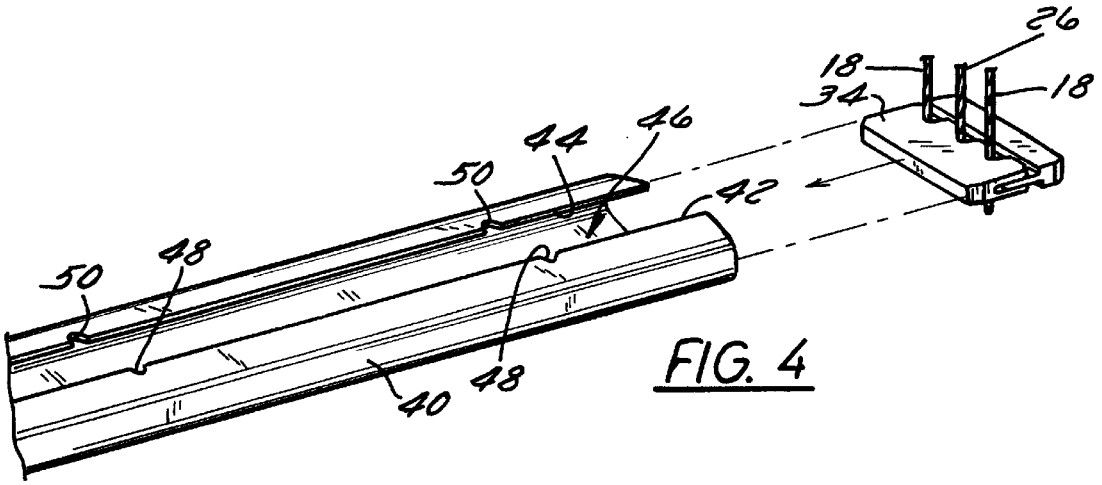
FIG. 4 is a perspective exploded partial view of the bottom rail with the retaining clip poised for entry into the channel.

Referring more particularly to FIG. 2, mini-blind assembly 10 is sized by placing a retaining clip 34 intermediate a bottom slat 36 and a top slat 38 to frictionally engage lift cord 26, then cutting ladder cords 18 and lift cord 26 directly beneath retaining clip 34 (below rung cords 20) and above bottom slat 36. Alternatively, the order in which a user clip, and then cuts ladder cords 18 and lift cord 26 to resize mini-blind assembly 10 may be reversed. Mini-blind assembly 10 may be resized by cutting ladder cords 18 and lift cord 26 between top slat 38 and bottom slat 36, then clipping retaining clip 34 around ladder cords 18 and lift cord 26. Capturing ladder cords 18 and lift cord 26, however, may be more difficult if cords 18, 26 are cut before they are clipped. A distance d1 between ladder cords 18 is larger than a distance d2 between ladder cords 18 (FIG. 3). Ladder cords 18 are generally drawn inward towards each other as they are placed in retaining clip 34. Ladder cords 18 are retained with lift cord 26 primarily to keep ladder cords 18 in a convenient position while sliding a bottom rail 40 over clip 34, as illustrated in FIG. 4. Mini-blind assembly 10 may be manufactured and purchased by the user with retaining clips 34 unattached to ladder cords 18 and lift cords 26. Lift cords 26 may be threaded through a hole in bottom rail 40 then knotted. A washer or similar device may also be used to temporarily secure ladder cords 18 and lift cords 26.

Figure 5:
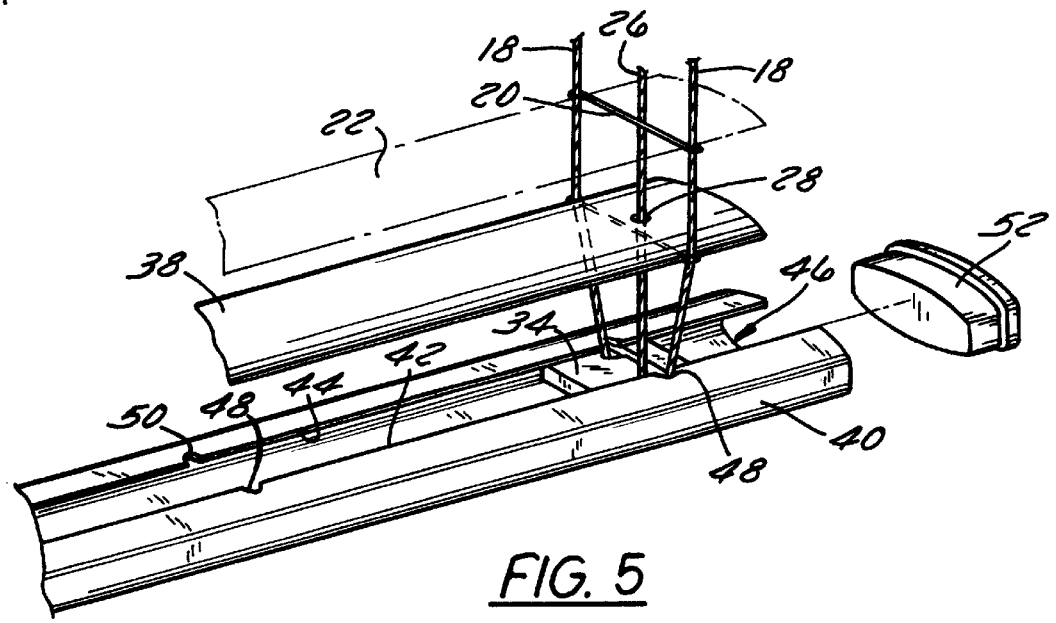
FIG. 5 is a perspective exploded partial view of the bottom rail with the retaining clip engaged in the channel and an end plug poised for entry into the bottom rail.

As shown in FIGS. 4–5, bottom rail 40 includes a pair of spaced apart flanges 42, 44 forming a channel 46 configured to slidably engage retaining clip 34. Bottom rail 40 further includes a pair of oppositely facing notches 48, 50 which receive and provide additional clearance for ladder cords 18. Notches 48, 50 also function to prevent clip 34 from freely sliding along bottom rail 40. In the preferred embodiment of the current invention, ladder cords 18 are spaced as far apart as possible within retaining clip 34. Retaining clip 34 can alternatively be configured only to frictionally engage lift cord 26, while ladder cords 18 can be tucked underneath clip 34 and retained with a plug or tied together underneath clip 34. An end plug 52 may be placed into each end of bottom rail 40 after retaining clip 34 is in place and ladder cords 18 are received in notches 48, 50. (FIG. 5) In the preferred embodiment, however, an end cap is placed over the ends of bottom rail 40 to completely cover any exposed edges on each end of rail 40. In the preferred embodiment of the present invention, mini-blind assembly 10 includes a plurality of flexible ladders 16 having corresponding retaining clips 34 engaged within channel 46 of bottom rail 40. In an alternative embodiment, channel 46 may also slidably engage single top slat 38 in addition to retaining clip 34. Such an arrangement results in a finished appearance by providing a covering for the opening along channel 46. In the preferred embodiment, bottom rail 40 is solely supported by clip 34 engaging flanges 42, 44.

Therefore, in both the preferred and alternate embodiments, no knotting of ladder cords 18 and lift cord 26 is required, which significantly simplifies the process of sizing the verticle length mini-blind assembly 10. There is no need to restring mini-blind assembly 10C and knot any cords or use any plug assemblies to support bottom rail 40. Ladder cords 18 and lift cord 26 may initially be knotted before mini-blind assembly 10 is sized, but it is still unnecessary to restring or retie any cords to size mini-blind assembly 10 because clip 34 frictionally engages lift cord 26.

Figure 6:
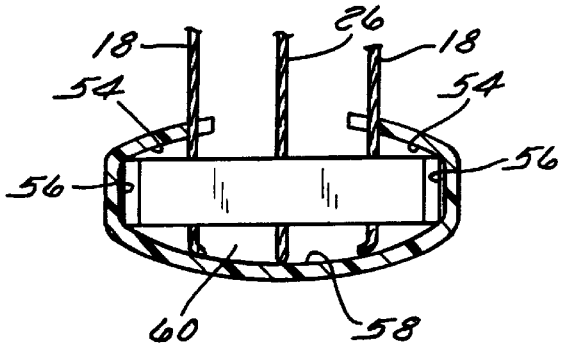
FIG. 6 is a plan view of the end portion of the bottom rail engaging the retaining clip without the end plug engaged.

As illustrated in FIG. 6, bottom rail 40 has a flange surface 54, a side surface 56 and a bottom surface 58. Retaining clip 34 slidably engages flange surface 54. A bottom cavity 60 formed by the space between bottom surface 58 and the underside of clip 34 provides adequate clearance for any excess ladder cords 18 and lift cord 26 extending below retaining clip 34. Bottom rail 40 remains flush with a window opening because ladder cords 18 and lift cord 26 are kept in cavity 60. In the prior art, light often enters a room between the bottom rail and the window opening because the ladder cords and lift cords are knotted and then plugged, which results in a displacement between the bottom rail and the window opening.

Figure 7:
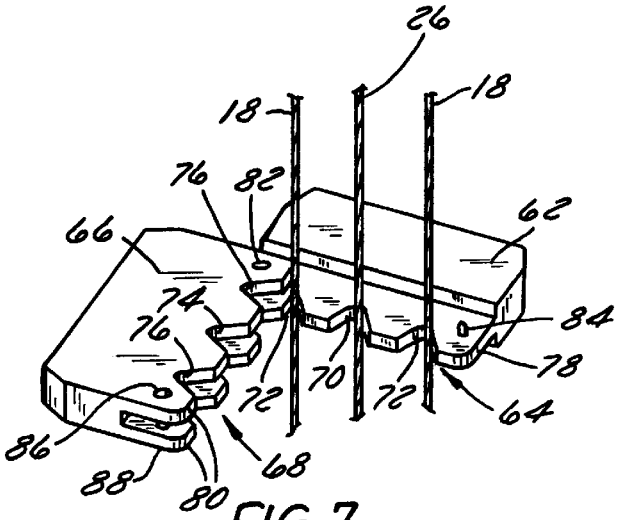
FIG. 7 is a perspective view of the retaining clip in an open position.
Figure 8:
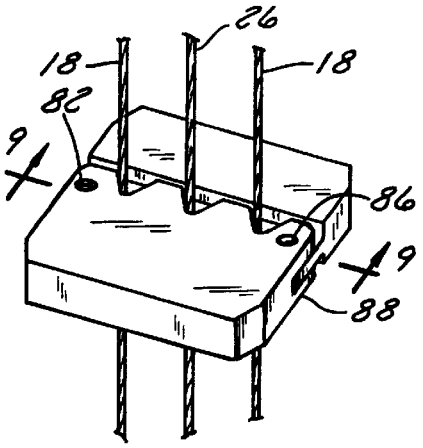
FIG. 8 is a perspective view of the retaining clip in a closed position.
Figure 9:
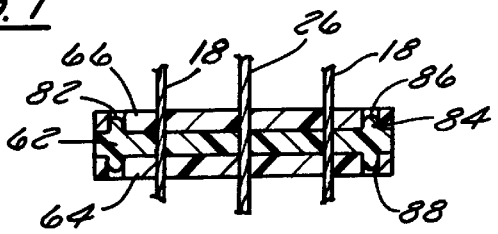
FIG. 9 is a cross-sectional view according to the present invention taken generally along line 9—9 of FIG. 8.
Figure 10:
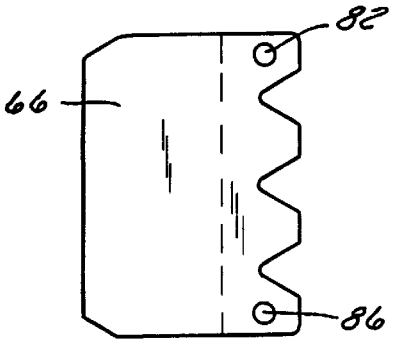
FIG. 10 is a top plan view of the second member of the retaining clip.
Figure 11:
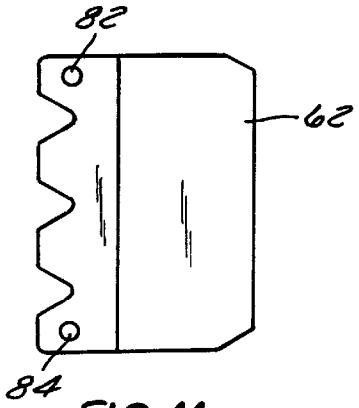
FIG. 11 is a top plan view of the first member of the retaining clip.
Figure 12:
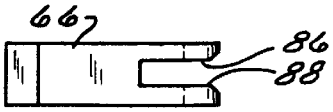
FIG. 12 is plan view of the end portion of the second member of the retaining clip.
Figure 13:
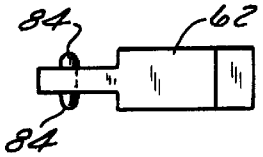
FIG. 13 is a plan view of the end portion of the first member of the retaining clip.

FIGS. 7–8 illustrate retaining clip 34 in substantially open and closed positions, respectively. Clip 34 includes a first member 62 having a first surface 64 and a second member 66 having a second surface 68. First surface 64 engages lift cord 26 at a first lift cord region 70 and ladder cords 18 at a first ladder cord region 72. Second surface 68 generally engages lift cord 26 at a second lift cord region 74 and ladder cords 18 at a second ladder cord region 76. First member 62 cooperates with second member 66 to frictionally engage ladder cords 18 and lift cord 26 between first lift cord region 70, first ladder cord regions 72 and second lift cord region 74 and second ladder cord regions 76. In particular, first member 62 has a single row of ridges 78 in interlocking pivoted engagement with second member 66 which has a double row of ridges 80 configured to receive single row of ridges 78 therebetween. First member 62 and second member 66 are pivoted about a pivot pin 82 inserted through members 62 and 66. First member 62 also has a locking pin 84 which is received in a top cavity 86 and a bottom cavity 88, both of which are formed in second member 66 and provide for locking engagement between members 62 and 66. FIGS. 9–13 further illustrate the pivoting of members 62 and 66 about pin 82 and the interlocking of members 62 and 66 using locking pin 84 disposed in cavities and 88. Pivot pin 82 and locking pin 84 may be any geometric shape including but not limited to a post or a dimple.

Figure 14:
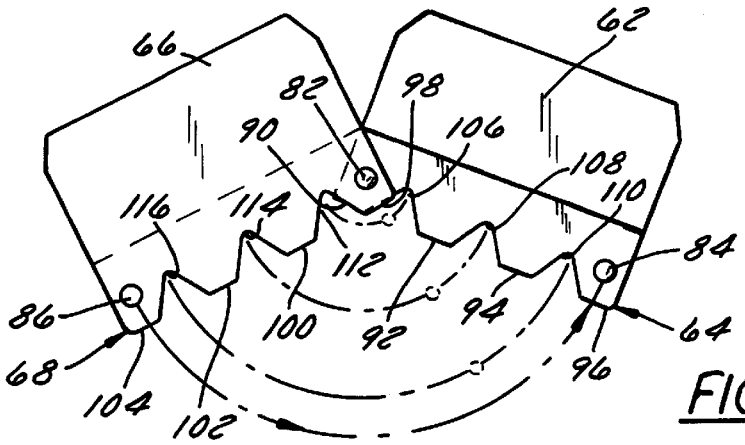
FIG. 14 is a top plan view of the retaining clip in an open position.
Figure 15:
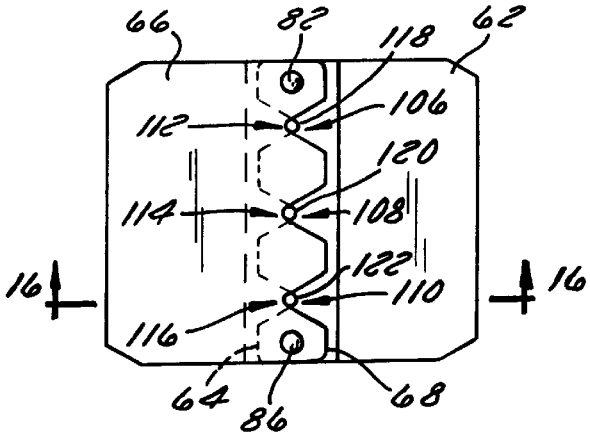
FIG. 15 is a top plan view of the retaining clip in a closed position.
Figure 16:
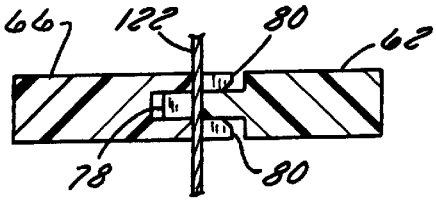
FIG. 16 is a cross-sectional view according to the present invention taken generally along line 16—16 of FIG. 15.

Referring particularly to FIGS. 14–16, first member 62 and second member 66 clip together in a complementary rather than a meshing configuration. More specifically, first member 62 has a first protrusion 90, a second protrusion 92, a third protrusion 94 and a fourth protrusion 96 along first surface 64, and second member 66 has a first cooperating protrusion 98, a second cooperating protrusion 100, a third cooperating protrusion 102 and a fourth cooperating protrusion 104 along second surface 68, respectively. Similarly, first member 62 has a first recess 106, a second recess 108, and a third recess 110 along first surface 64, and second member 66 has a first cooperating recess 112, a second cooperating recess 114 and a third cooperating recess 116 along second surface 68, respectively.

As more clearly shown in FIGS. 15–16, the significant overlapping nature of generally V-shaped first recess 106 with cooperating first recess 112 forms a first aperture 118 configured to receive ladder cord 18, second recess 108 with cooperating second recess 114 forms a second aperture 120 configured to receive lift cord 26, and third recess 110 with third cooperating recess 116 forms a third aperture 122 configured to receive another ladder cord 18. In order to frictionally engage lift cord 26, the diameter of second aperture 120 is significantly smaller than the diameters of lift cord 26. More particularly, the diameter of aperture 120 is preferably in the range of 30% to 70% of the diameter of lift cord 26. The diameter of lift cord 26 is often difficult to measure depending on the type of material used to fabricate the cord. For example, if lift cord 26 is made of a woven fiber, the diameter of lift cord 26 may be in the range of 0.040" to 0.080" (preferably 0.060") and the diameter of aperture 120 may be in the range of 0.012" to 0.052" (preferably 0.032" which is approximately 53% of the diameter of lift cord 26). This percentage representing the size or ratio relationship between lift cord 26 and aperture 120, however, significantly varies depending on the type of material used to fabricate lift cord 26 and the size of slats 22. In the preferred embodiment of the current invention, ladder cords 18 are allowed to slide within apertures 118 and 122. In other words, the diameter of ladder cords 18 are approximately the sane diameter of apertures 118 and 122.

Figure 17:
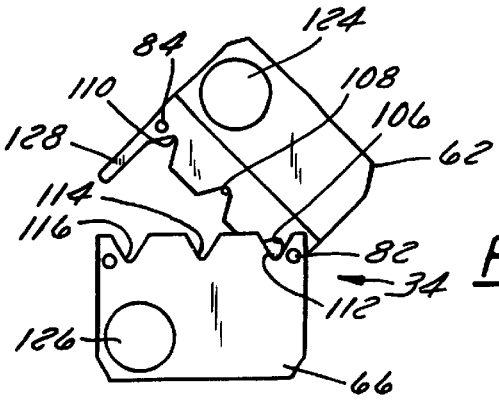
FIG. 17 is a perspective view of the preferred embodiment of the retaining clip in an open position.

As illustrated in FIG. 17, retaining clip 34 preferably includes a generally circular first indentation 124 in first member 62 and a generally circular second indentation 126 in second member 66. First and second indentations 124, 126 on clip 34 may be coated with a non-slip surface such as a rubber compound to allow a user to easily grip and snap members 62 and 66 into place. In the preferred embodiment of the present invention, first member 62 of clip 34 has an elongated prong 128 extending generally perpendicular to the longitudinal axis formed through pivot pin 82 and locking pin 84. Prong 128 guides ladder cords 18 into alignment with recesses 106, 112 and 110, 116. Finally, retaining clip 34 is molded ABS or, in the alternative, clip 34 may be molded nylon.

Figure 18:
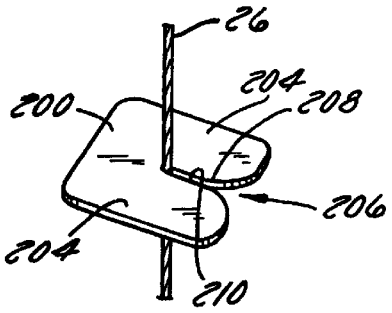
FIG. 18 is a perspective view of a first alternate embodiment of the retaining clip.
Figure 19:
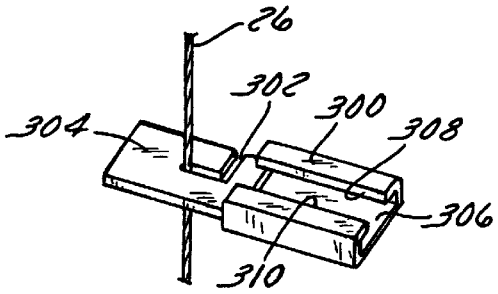
FIG. 19 is a perspective view of a second alternate embodiment of the retaining clip in an open position.
Figure 20:
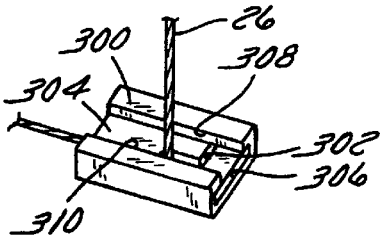
FIG. 20 is a perspective view of the second alternate embodiment of the retaining clip in FIG. 19 in a closed position.

In a first alternative shown in FIG. 18, a retaining clip 200 may have a first member 202 integrally molded with a second member 204 to form an elongated slot 206 which frictionally retains lift cord 26 between a first surface 208 and a second surface 210. In a second embodiment, a retaining clip 300 may include a L-shaped slot 302 formed in a first member 304 configured to receive lift cord 26, and a second member 306 having a pair of oppositely facing flanges 308, 310 configured to slidably engage first member 304. (FIGS. 19–20)

Figure 21:
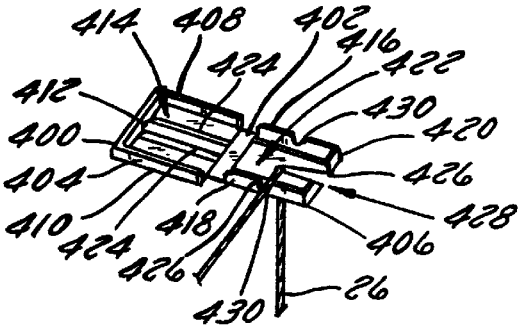
FIG. 21 is a perspective view of a third alternate embodiment of the retaining clip in an open position.
Figure 22:
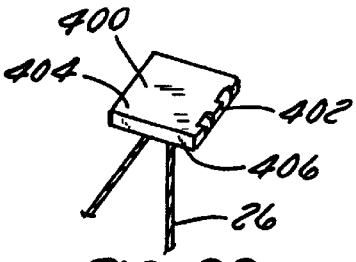
FIG. 22 is a perspective view of the third alternate embodiment of the retaining clip in FIG. 21 in a closed position.

In a third embodiment illustrated in FIGS. 21–22, a retaining clip 400 may have a hinge 402 disposed between and attached to a first member 404 and a second member 406. First member 404 includes a pair of oppositely facing side walls 408, 410 and an end wall 412 protruding from a first bottom plate 414. Second member 406 includes a pair of oppositely facing side walls 416, 418 and an end wall 420 protruding from a second bottom plate 422. First member 404 further includes a first pair of spaced apart teeth 424, second member 406 further includes a second pair of spaced apart teeth 426 and the area of first bottom plate 414 is generally larger than the area of second bottom plate 422, thereby allowing second member 406 to fit within first member 404. Lift cord 26 is inserted through a V-shaped slot 428 formed in second bottom plate 422, frictionally engaged by first teeth 424 when clip 400 is in a closed position. Lift cord 26 is also inserted through a slot 430 formed in side walls 416, 418 and frictionally engaged by second teeth 426 when clip 400 is in a closed position illustrated in FIG. 22. Clip 400 includes a snap-shut feature when first bottom plate 414 and second bottom plate 422 are closed.

Figure 23:
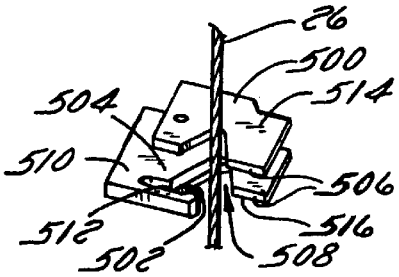
FIG. 23 is a perspective view of a fourth alternate embodiment of the retaining clip in an open position.
Figure 24:
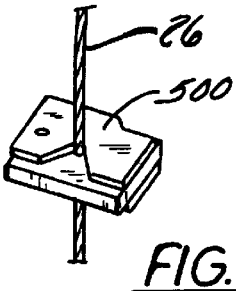
FIG. 24 is a perspective view of the fourth alternate embodiment of the retaining clip in FIG. 23 in a closed position.

Finally, as shown in FIGS. 23 and 24, a fourth embodiment includes lift cord 26 retained by a clip 500 having single row of ridges 502 consisting of a protrusion 504 meshingly engaging double row of ridges 506 consisting of a recess 508. In this alternate configuration, lift cord 26 is retained by distorting the vertical alignment of lift cord 26 wherein a first member 510 having a first surface 512 abuts lift cord 26 against a second member 514 having a second surface 516.

It is understood that the above description is of a preferred exemplary embodiment of this invention, and that the invention is not limited to the specific forms described. For example, the clips may include additional surfaces in engagement with the lift and ladder cords. Also, the retaining clips may be used in other window covering systems, including pleated shades. Additionally, the lift and ladder cords may be retained a clip having piercing members which actually extend through the lift cord and the ladder cords. These and other modifications may be made in the design and arrangement of the elements without departing from the scope of the invention as expressed in the appended claims.

What is claimed is:

1. A method of sizing a window covering having a bottom rail and a series of horizontal slats, comprising the steps of:

attaching a retaining clip to an unknotted lift cord which extends through the series of horizontal slats, the retaining clip having a slot for receiving and frictionally retaining the lift cord;

cutting the lift cord; and sliding the retaining clip into the bottom rail having a pair of spaced apart flanges forming a channel; and wrapping the lift cord around the retaining clip such that the lift cord passes through the slot at least twice.

2. A method of sizing a window covering, comprising the steps of:

attaching a retaining clip to a lift cord which extends through a series of horizontal slats, the retaining clip including a plurality of engagement surfaces for engaging and retaining the lift cord, wherein the engagement surfaces define a notch for receiving the lift cord;

cutting the lift cord;

positioning the retaining clip in a channel of a bottom rail; and wrapping the lift cord around the retaining clip such that the lift cord passes through the notch at least twice.

3. A method of sizing a window covering, comprising the steps of:

attaching a retaining clip to a lift cord which extends through a series of horizontal slats, the retaining clip including a plurality of engagement surfaces for engaging and retaining the lift cord, the engagement surfaces defining a slot;

cutting the lift cord;

positioning the retaining clip in a channel of a bottom rail;

wrapping the lift cord around the retaining clip such that the lift cord passes through the slot at least twice; and wherein the positioning step comprises sliding the retaining clip into the channel.

* * * * *